US011219568B2

(12) United States Patent
Yuh et al.

(10) Patent No.: US 11,219,568 B2
(45) Date of Patent: Jan. 11, 2022

(54) STANDING ASSISTANCE APPARATUS

(71) Applicant: KOREA INSTITUTE OF SCIENCE AND TECHNOLOGY, Seoul (KR)

(72) Inventors: Junku Yuh, Seoul (KR); Sung Chul Kang, Seoul (KR); Woosub Lee, Seoul (KR); Seungwon Kim, Seoul (KR); Jiyeon Song, Seoul (KR); Gang Tae Bae, Seoul (KR)

(73) Assignee: KOREA INSTITUTE OF SCIENCE AND TECHNOLOGY, Seoul (KR)

( * ) Notice: Subject to any disclaimer, the term of this patent is extended or adjusted under 35 U.S.C. 154(b) by 663 days.

(21) Appl. No.: 16/166,158

(22) Filed: Oct. 22, 2018

(65) Prior Publication Data

US 2019/0133859 A1 May 9, 2019

(30) Foreign Application Priority Data

Nov. 6, 2017 (KR) ..... 10-2017-0146659

(51) Int. Cl.
*A61G 7/10* (2006.01)

(52) U.S. Cl.
CPC ..... *A61G 7/1017* (2013.01); *A61G 7/1019* (2013.01); *A61G 7/1046* (2013.01); *A61G 7/1059* (2013.01)

(58) Field of Classification Search
CPC .. A61G 7/1017; A61G 7/1019; A61G 7/1059; A61G 7/1046; A61G 7/1096; A61G 7/1015; A61G 7/10; A61G 7/1001; A61G 7/1013; A61G 7/1061; A61H 3/00; A61H 3/04; A61H 2201/16; A61H 2201/1628; A61H 2201/163; A61H 2201/1633
See application file for complete search history.

(56) References Cited

U.S. PATENT DOCUMENTS 6,539,569 B2 4/2003 O'Connell
2005/0268397 A1* 12/2005 Nativ ..... A61G 7/1051 5/86.1

(Continued)

FOREIGN PATENT DOCUMENTS

EP 1595519 A1 11/2005
EP 2853249 A1 4/2015

(Continued)

OTHER PUBLICATIONS

Seung-Won Kim et al., "Design and Experiment of a Passive Sit-to-Stand and Walking (STSW) Assistance Device for the elderly", IEEE Engineering in Medicine and Biology Society, 2018, pp. 1781-1784.

(Continued)

*Primary Examiner* — Quang D Thanh
(74) *Attorney, Agent, or Firm* — Cantor Colburn LLP

(57) ABSTRACT

The present disclosure provides a standing assistance apparatus including a support part configured to support a load, a saddle part configured to accommodate a patient to allow the patient to position from sitting condition to standing condition, and a guide part coupled between the support part and the saddle part and having an adjustable length to guide the patient to stand, wherein the guide part is disposed in diagonal direction with respect to the support part to guide the patient to stand in the diagonal direction.

12 Claims, 15 Drawing Sheets

(56) References Cited

U.S. PATENT DOCUMENTS

| | | | | |
|---|---|---|---|---|
| 2009/0188038 | A1* | 7/2009 | Raney | A61G 7/1046 5/87.1 |
| 2012/0280464 | A1 | 11/2012 | Nelson et al. | |
| 2016/0120722 | A1* | 5/2016 | Mueller | A61G 7/1017 187/200 |
| 2016/0166451 | A1* | 6/2016 | Tekulve | A63B 21/40 297/5 |
| 2017/0156959 | A1* | 6/2017 | Domenick | A61G 5/14 |

FOREIGN PATENT DOCUMENTS

| | | | |
|---|---|---|---|
| JP | 69591 | B2 | 2/1994 |
| JP | 9570 | A | 1/1997 |
| JP | 9299414 | A | 11/1997 |
| JP | 11188063 | A | 7/1999 |
| JP | 2003305096 | A | 10/2003 |
| KR | 101320043 | B1 | 10/2013 |
| WO | 2010085332 | A2 | 7/2010 |

OTHER PUBLICATIONS

Korean Notice of Allowance for KR Application No. 10-2017-0146659 dated Feb. 25, 2020.

Raising support product "Roll On" of Liko Company (http://www.liko.com/ie/Ireland/Videos/Video-Archive/RollOn1/RollOn-Transfer-between-bed-and-wheelchair/), Oct. 25, 2016.

* cited by examiner

STANDING ASSISTANCE APPARATUS

CROSS-REFERENCE TO RELATED APPLICATION

This application claims priority to Korean Patent Application No. 10-2017-0146659, filed on Nov. 6, 2017, and all the benefits accruing therefrom under 35 U.S.C. § 119, the contents of which in its entirety are herein incorporated by reference.

BACKGROUND

1. Field

The present disclosure relates to a standing assistance apparatus, and more particularly, to a standing assistance apparatus for guiding a patient in diagonal direction to assist the patient to stand.

2. Description of the Related Art

The introduction of comprehensive nursing care removes the need for caregivers in hospitals and increases the physical tasks of nurses. In addition, with the increasing number of old people living alone, there is the increasing demand for mobility aids in indoor/outdoor spaces of hospitals and nursing facilities. By these reasons, there is a need for assist devices to support physical activities of patients or old people who have difficulties in standing themselves in replace of nurses.

In conventional standing assist devices, there are a method that allows patients or old people to stand based on the muscular strength of the upper body by holding frames with two hands and supporting knees without a moving element, and a method that allows patients or old people to stand by the help of an automatic device using an electric power source such as a motor.

The upper body muscular strength-based standing method provides patients with the ability to stand themselves to allow them to stand, and thus there is a problem with strain placed on their arms or knees.

Additionally, the method using an electric power source needs medical equipment certification for practical use in hospitals as well as battery charging and a power line, causing inconvenience. Moreover, the use of a control board and a motor increases the production costs.

Meanwhile, among the conventional standing assistance devices, there is a standing assistance device using driving rails (or supports) running on two sides of a user, or a standing assistance device using a harness installed at a user's hip and an actuator above the user's head.

In the case of the standing assistance device with the driving rails, its disadvantage is a large size, and in the case of the standing assistance device using the harness, the user needs an assistant to wear the harness, causing inconvenience to both the assistant and the user, and as the standing support takes place above the head, the user stands up as if the user is suspended, causing displeasure to the user.

SUMMARY

The present disclosure is designed to solve the above-described problem, and an object of the present disclosure is to provide a standing assistance apparatus for assisting a patient or a weak and old person to stand with a small force.

Another object of the present disclosure is to provide a standing assistance apparatus for assisting a patient or a weak and old person to stand without using an electric power source or an actuator.

To solve the above-described problem, a standing assistance apparatus of the present disclosure includes a support part configured to support a load, a saddle part configured to accommodate a patient to allow the patient to position from sitting condition to standing condition, and a guide part coupled between the support part and the saddle part and having an adjustable length to guide the patient to stand, wherein the guide part is disposed in diagonal direction with respect to the support part to guide the patient to stand in the diagonal direction.

The standing assistance apparatus of the present disclosure may further include a frame installed below the support part to support the support part, and a knee support part may be installed in the frame to support the patient's knees.

The frame may include a first member which is connected to bottom of the support part and extends in a direction in which the first member intersects with the support part, the first member having a received guide part therein along the direction in which the first member extends, and a second member which is inserted into and guided by the received guide part moveably relative to the first member, and the knee support part may be installed in the second member.

The frame may further include an elastic part which is installed within the first member, wherein the elastic part elastically deforms between the first and second members when the second member moves relative to the first member, to provide an elastic force to the knee support part, a ratchet gear which is installed at an end of the second member and is disposed along the direction in which the second member extends, and a stopper part which is installed in the first member to latch the ratchet gear to limit the movement of the knee support part toward the support part.

According to another embodiment of the present disclosure, the standing assistance apparatus of the present disclosure may further include a driving part which is installed within the support part to generate driving power for allowing the patient to stand, and a power transmission part which is connected between the driving part and the guide part to transmit the generated driving power to the guide part to adjust the length of the guide part.

The driving part may include a gas cylinder which is installed in one direction within the support part to generate the driving power, and a gas spring which is installed in parallel with the gas cylinder within the support part to assist the generation of the driving power.

A fixed block may be installed at an inner periphery of the support part and have a guide hole formed in one direction, and the driving part may further include a guide rod installed in parallel with the gas cylinder within the support part, and the guide rod may be supplied with the driving power and guided by the guide hole together with the gas cylinder.

The power transmission part may include a first pulley which is connected to the driving part to move using the driving power received from the driving part, second and third pulleys which are installed at adjacent ends of the support part and the guide part respectively, and a wire having two ends, each fixed to an inner side of the support part and other end of the guide part, the wire being installed in the first to third pulleys to transmit the driving power generated by the driving part to the guide part through the first to third pulleys.

According to still another embodiment of the present disclosure, the guide part may include a case having a shaft receiving part inside and extending in the diagonal direction, and a shaft which is inserted into the shaft receiving part moveably relative to the case.

The guide part may further include a boss which is installed at an outer periphery of the shaft to guide the movement of the shaft, and latch an end of the shaft to limit the movement of the shaft.

Two cases and two shafts may be provided, a first case may be coupled to the support part, a first shaft may be inserted into the first case moveably relative to the first case, a second case may be disposed in parallel with the first case at an outer periphery of the first case, a second shaft may be inserted into the second case moveably relative to the second case with one end being coupled to the saddle part, the first case may have a cutout part which is cut along the diagonal direction at an outer periphery, and the second case may be guided by the cutout part and make a relative motion in the diagonal direction with respect to the first case.

DETAILED DESCRIPTION

Hereinafter, the embodiments disclosed in the specification will be described in detail with reference to the accompanying drawings, in which identical or similar drawing signs are given to identical or similar elements and their overlapping description is omitted herein. The suffix "unit" added to the element as used in the following description is only given or used in consideration of easiness to prepare the specification, and does not have any meaning or role in distinguishing the elements itself. Additionally, in describing the embodiments disclosed in the specification, when it is deemed that a certain detailed description of relevant known technology renders the subject matter of the embodiments disclosed in the specification ambiguous, the detailed description is omitted herein. Additionally, it should be understood that the accompanying drawings are only provided to help better understand the embodiments disclosed in the specification, and the technical idea disclosed in the specification is not limited by the accompanying drawings and covers all modification, equivalents or alternatives included in the spirit and technical scope of the present disclosure.

The terms including the ordinal number such as "first", "second" and the like, may be used to describe various elements, but the elements are not limited by the terms. The terms are only used to distinguish one element from another.

It will be understood that when an element is referred to as being "connected to" another element, it may be directly connected to the other element or intervening elements may be present.

As used herein, the singular forms are intended to include the plural forms as well, unless the context clearly indicates otherwise.

It will be understood that the terms "comprises" or "includes" when used in this specification, specify the presence of stated features, integers, steps, operations, elements, components or groups thereof but do not preclude the presence or addition of one or more other features, integers, steps, operations, elements, components or groups thereof.

A standing assistance apparatus 100 of the present disclosure includes a support part 10, a saddle part 20 and a guide part 30.

Figure 1:
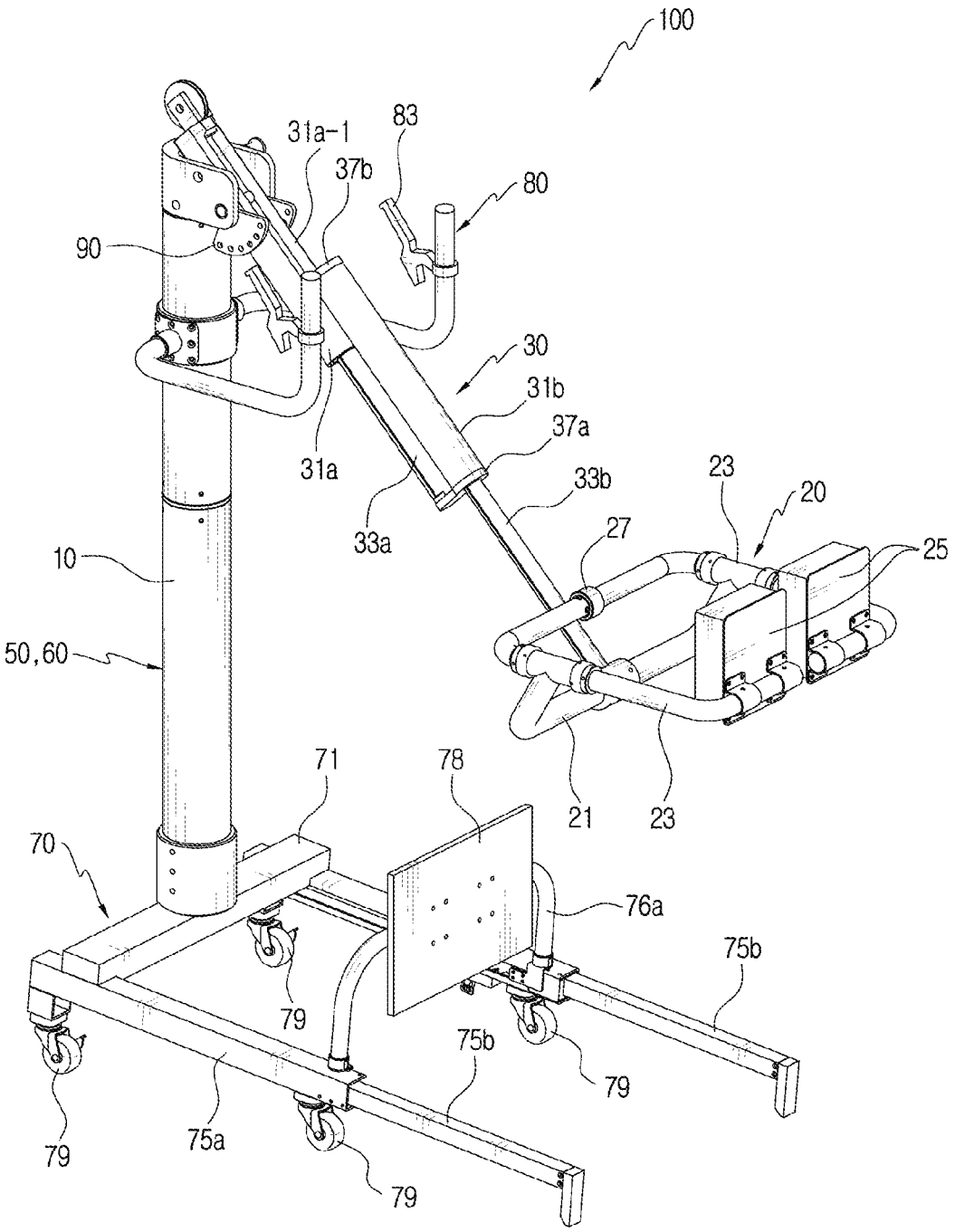
FIG. 1 is a perspective view showing an example of a standing assistance apparatus of the present disclosure.

The support part 10 is designed to support loads. FIG. 1 shows an example of the support part 10 placed in the up/down direction to support loads of a patient and other components connected to the support part 10. Additionally, the support part 10 needs to have a receiving space 13 in which a driving part 50 and a power transmission part 60 as described below may be installed, and to this end, the support part 10 is preferably hollow. For example, the support part 10 may be formed in the shape of a long circular pipe, but is not limited thereto.

The saddle part 20 accommodates the patient so that the patient may be positioned in sitting condition and standing condition. The saddle part 20 may include a connecting frame 21 to supportably connect a rotation rod 23 and a patient holding part 25 to the guide part 30, the rotation rod 23 to allow the patient holding part 25 and a linking part 27 to rotate, the patient holding part 25 to hold the patient from sitting condition to standing condition, and the linking part 27 to link the ends of the rotation rod 23.

Figure 3A:
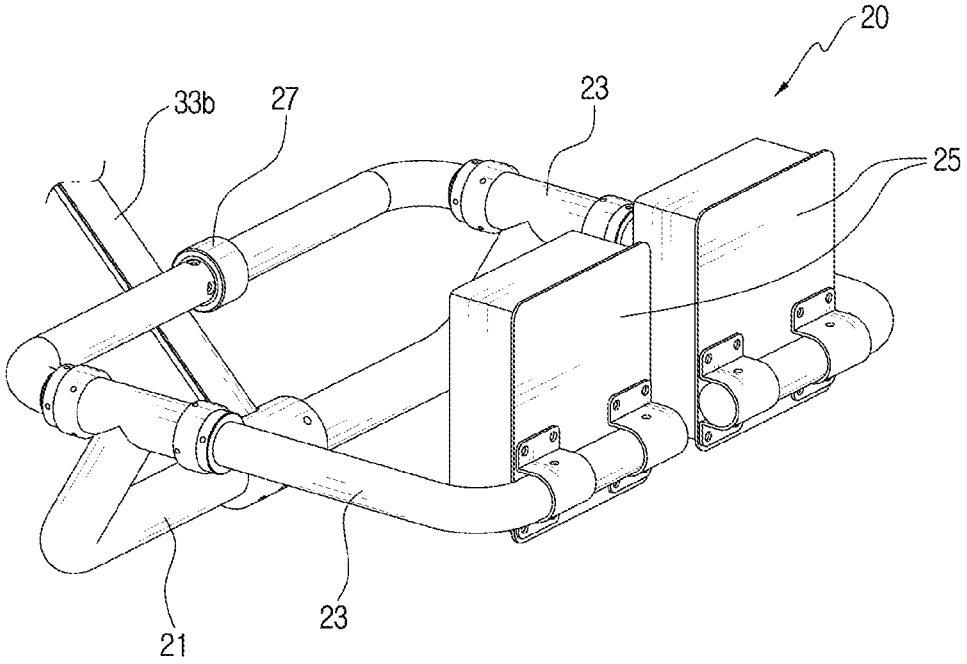
FIG. 3A is a perspective view showing an example of a saddle part before a patient is accommodated.
Figure 3B:
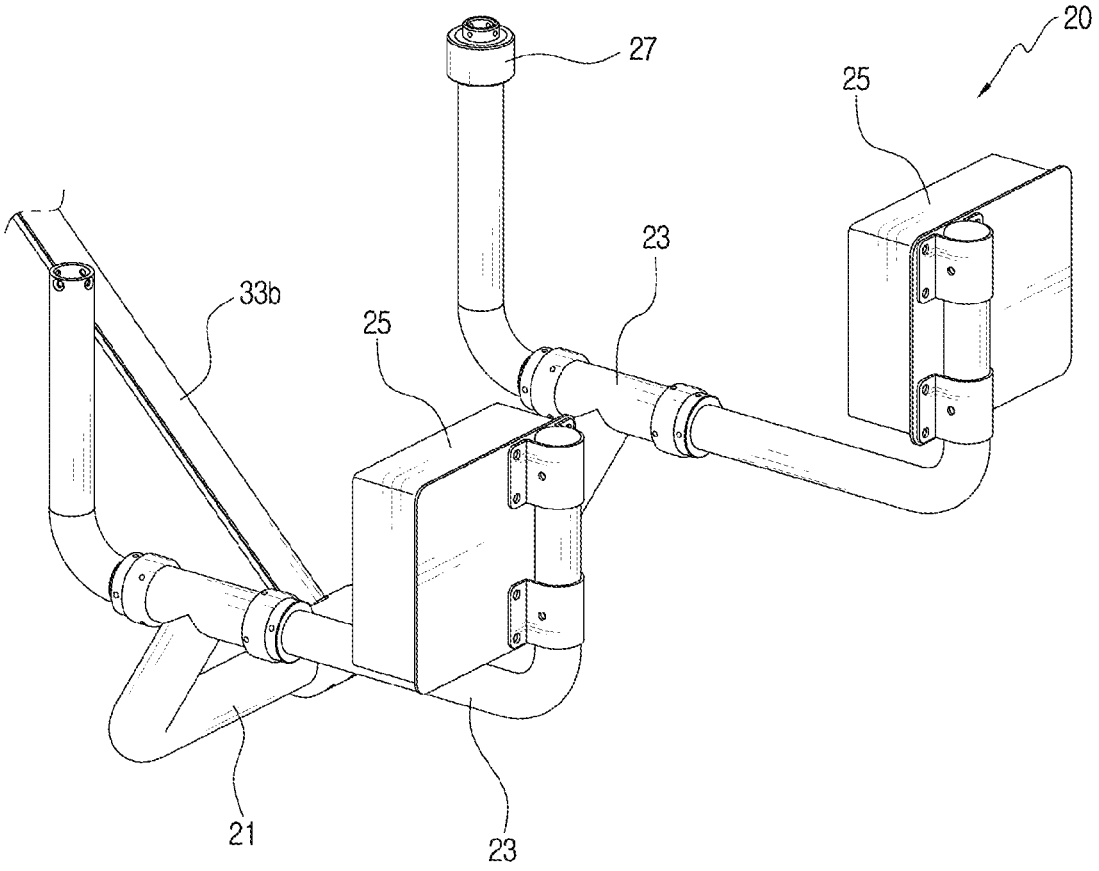
FIG. 3B is a perspective view showing an example of a saddle part when a patient is accommodated or may be accommodated.
Figure 4:
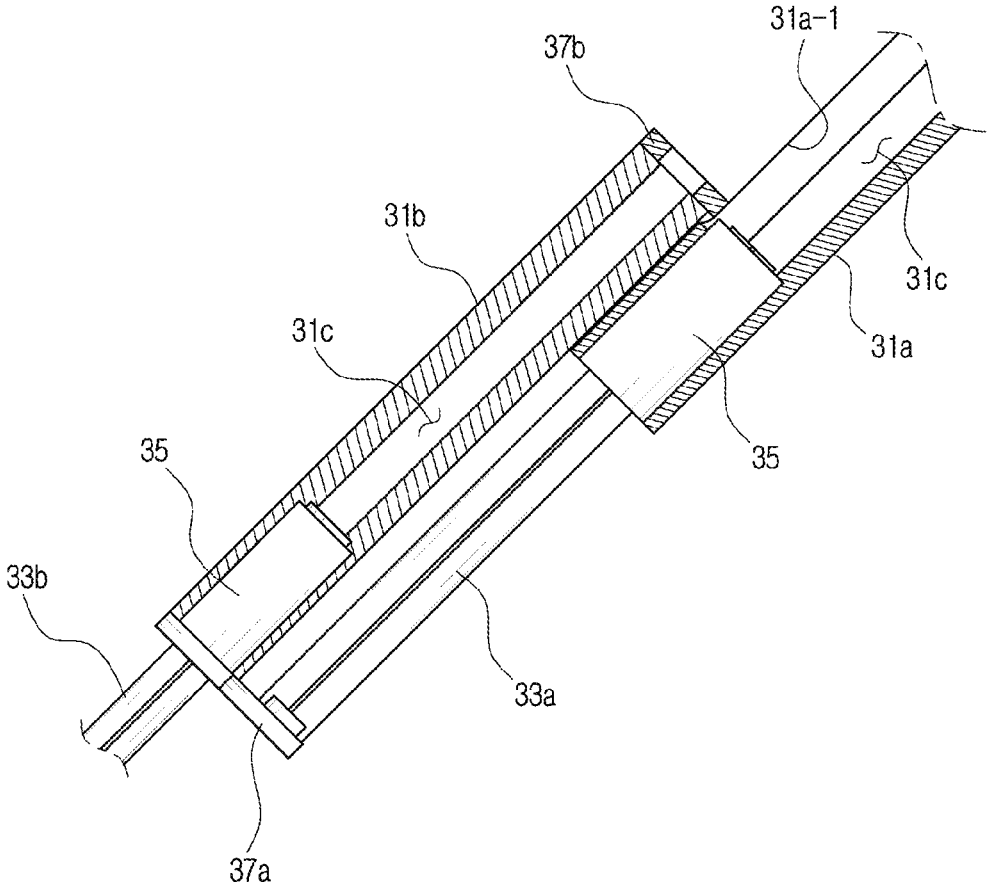
FIG. 4 is an enlarged view of section A of FIG. 2A.

Referring to FIGS. 1, 3A and 3B, the connecting frame 21 is coupled to the guide part 30 in a direction in which the connecting frame 21 intersects with the guide part 30, and the rotation rod 23 is rotatably connected to the connecting frame 21.

Additionally, the patient holding part 25 holds the patient in sitting condition, in guided condition from sitting condition to standing condition and in standing condition, and FIG. 3A shows an example in which the patient holding part 25 is installed in the rotation rod 23 at the lower end of the guide part 30 to hold the patient's back and waist.

Meanwhile, the linking part 27 links the ends of the rotation rod 23 so that the patient holding part 25 may hold the patient.

The guide part 30 is coupled between the support part 10 and the saddle part 20. Additionally, the length of the guide part 30 is adjustable so that the guide part 30 guides the standing of the patient from the sitting condition of the patient to the standing condition. As the guide part 30 is disposed in diagonal direction with respect to the support part 10, the patient may be guided in diagonal direction by the guide part 30 when the patient sits on the saddle part 20.

The guide part 30 may include case 31*a*, 31*b*, shaft 33*a*, 33*b* and boss 35.

The case 31*a*, 31*b* has a shaft receiving part 31*c* inside, and extends in the diagonal direction. For example, the case 31*a*, 31*b* may be formed in the shape of a pipe into which the shaft 33*a*, 33*b* is inserted moveably relative to the case 31*a*, 31*b*, but is not limited thereto.

The shaft 33*a*, 33*b* is inserted into the shaft receiving part 31*c* moveably relative to the case 31*a*, 31*b*.

The boss 35 is installed at the outer periphery of the shaft 33*a*, 33*b* to guide the movement of the shaft 33*a*, 33*b*, and locks the end of the shaft 33*a*, 33*b* to limit the movement of the shaft 33*a*, 33*b*. Additionally, the boss 35 locks the end of the shaft 33*a*, 33*b* to prevent the separation of the shaft 33*a*, 33*b* when the relative distance between the shaft 33*a*, 33*b* and the case 31*a*, 31*b* is large. For example, the boss 35 may be installed on one inner side of the case 31*a*, 31*b*.

Accordingly, when the patient is in sitting condition, the shaft 33*a*, 33*b* may be disposed at the maximum protruding location from the case 31*a*, 31*b*, and when the patient is in standing condition, the shaft 33*a*, 33*b* may be received in the case 31*a*, 31*b* to the maximum. In this way, the length of the guide part 30 may be adjusted.

Meanwhile, the guide part 30 may include two cases 31*a*, 31*b* and two shafts 33*a*, 33*b*, and its description is provided below. For convenience of description, the case that is directly coupled to the support part 10 will be referred to a first case 31*a*, the shaft that is received in the first case 31*a* will be referred to as a first shaft 33*a*, the shaft that is directly connected to the saddle part will be referred to as a second shaft 33*b*, and the case that receives the second shaft 33*b* will be referred to as a second case 31*b*.

Figure 2A:
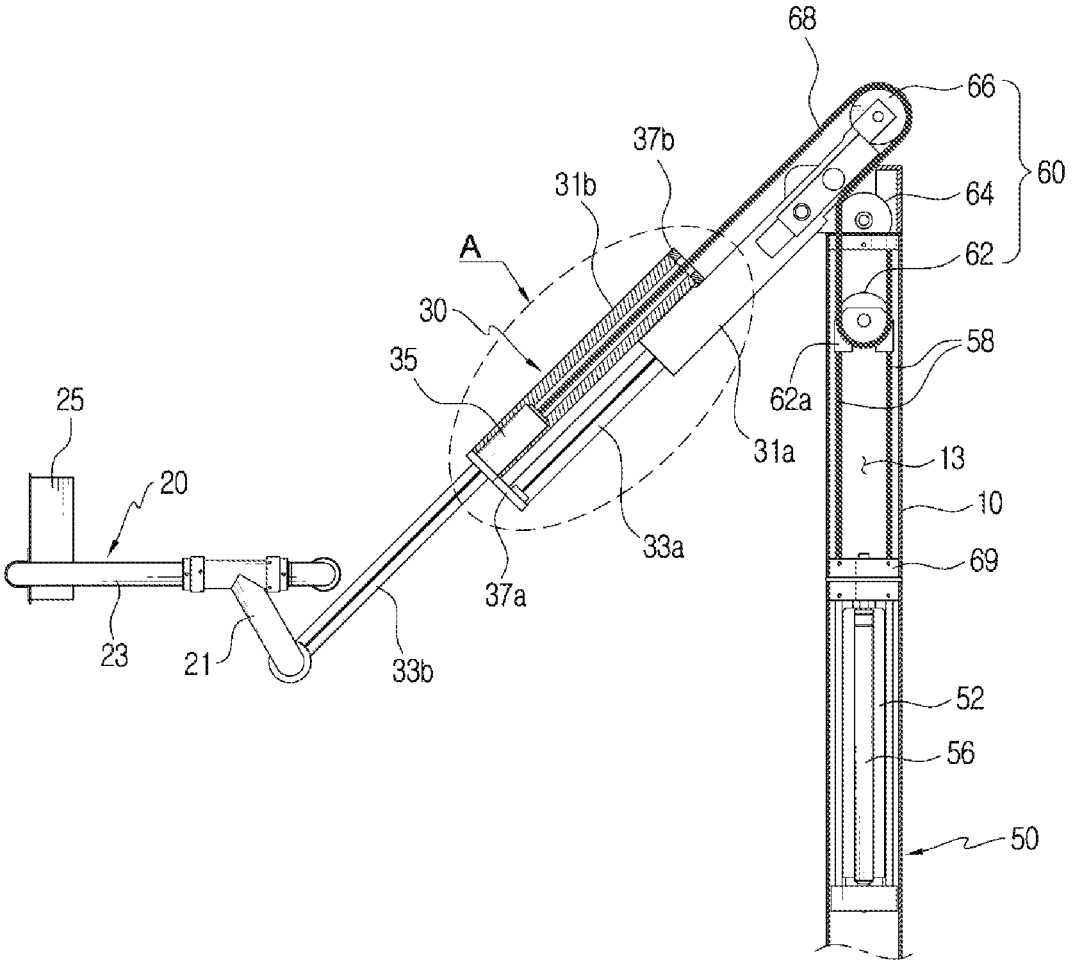
FIG. 2A is a conceptual diagram showing the structure and operation of a guide part, a driving part and a power transmission part when a patient sits down.

As shown in FIGS. 1 and 2A, the first case 31*a* has a cutout part 31*a*-1 where a part of the first case 31*a* is cut, and the second case 31*b* makes a relative motion by guidance of the cutout part 31*a*-1 of the first case 31*a*. Accordingly, the relative distance between the first and second cases 31*a*, 31*b* may be adjusted.

Additionally, there is no big difference in operation between the first case 31*a* and the first shaft 33*a*, and between the second case 31*b* and the second shaft 33*b*. The boss 35 may be each installed in between the first case 31*a* and the first shaft 33*a* and between the second case 31*b* and the second shaft 33*b*.

Meanwhile, as shown in FIGS. 1 and 2A, a connecting plate 37*a*, 37*b* may be installed at two ends of the first shaft 33*a* and the second case 31*b* to connect them each other. The connecting plates 37*a*, 37*b* allow the first shaft 33*a* and the second case 31*b* to move relative to the first case 31*a* together, and when the first shaft 33*a* is inserted into the first case 31*a*, the second case 31*b* is allowed to move together by guidance along the cutout part 31*a*-1 of the first case 31*a*. The first connecting plate 37*a* has a hole to allow the second shaft 33*b* to move, and the second connecting plate 37*b* has a hole to allow the first shaft 33*a* to move.

The first and second connecting plates 37*a*, 37*b* has a hole to allow the second shaft 33*b* and the first shaft 33*a* to move respectively, and when the patient stands up, the first and second shafts 33*a*, 33*b* may be inserted into the first and second cases 31*a*, 31*b* respectively.

As described above, as the shaft 33*a*, 33*b* is installed within the case and makes a relative motion, the length of the guide part 30 may be adjusted, and the guide part 30 guides the standing from sitting condition of the patient to standing condition.

Meanwhile, the guide part 30 is connected to the power transmission part 60 that transmits power generated by the driving part 50 to transmit the power for length adjustment, and the driving part 50 and the power transmission part 60 will be described below.

The standing assistance apparatus 100 of the present disclosure may further include a base frame 70 installed below the support part 10 to support the support part 10. A knee support part 78 may be installed in the base frame 70 to support the patient's knees.

The base frame 70 may include first and second members 75*a*, 75*b*.

The first member 75*a* is coupled to the bottom of the support part 10 and extends in a direction in which the first member 75*a* intersects with the support part 10, and includes a received guide part 75*a*-1 therein along the direction in which the first member 75*a* extends.

Figure 5A:
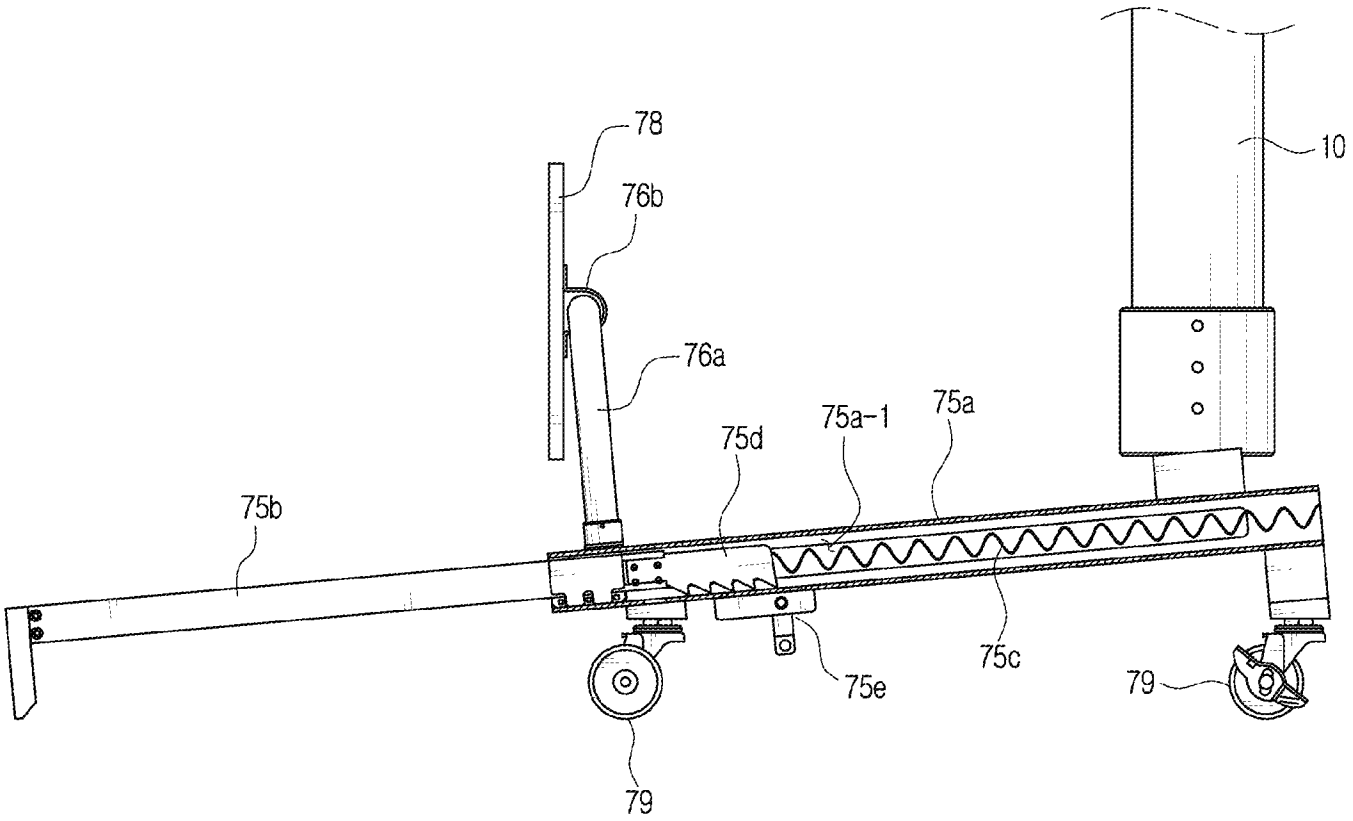
FIG. 5A is a conceptual diagram showing an example of a base frame when a second member protrudes forward from a first member and a knee support part is close to a patient.
Figure 5B:
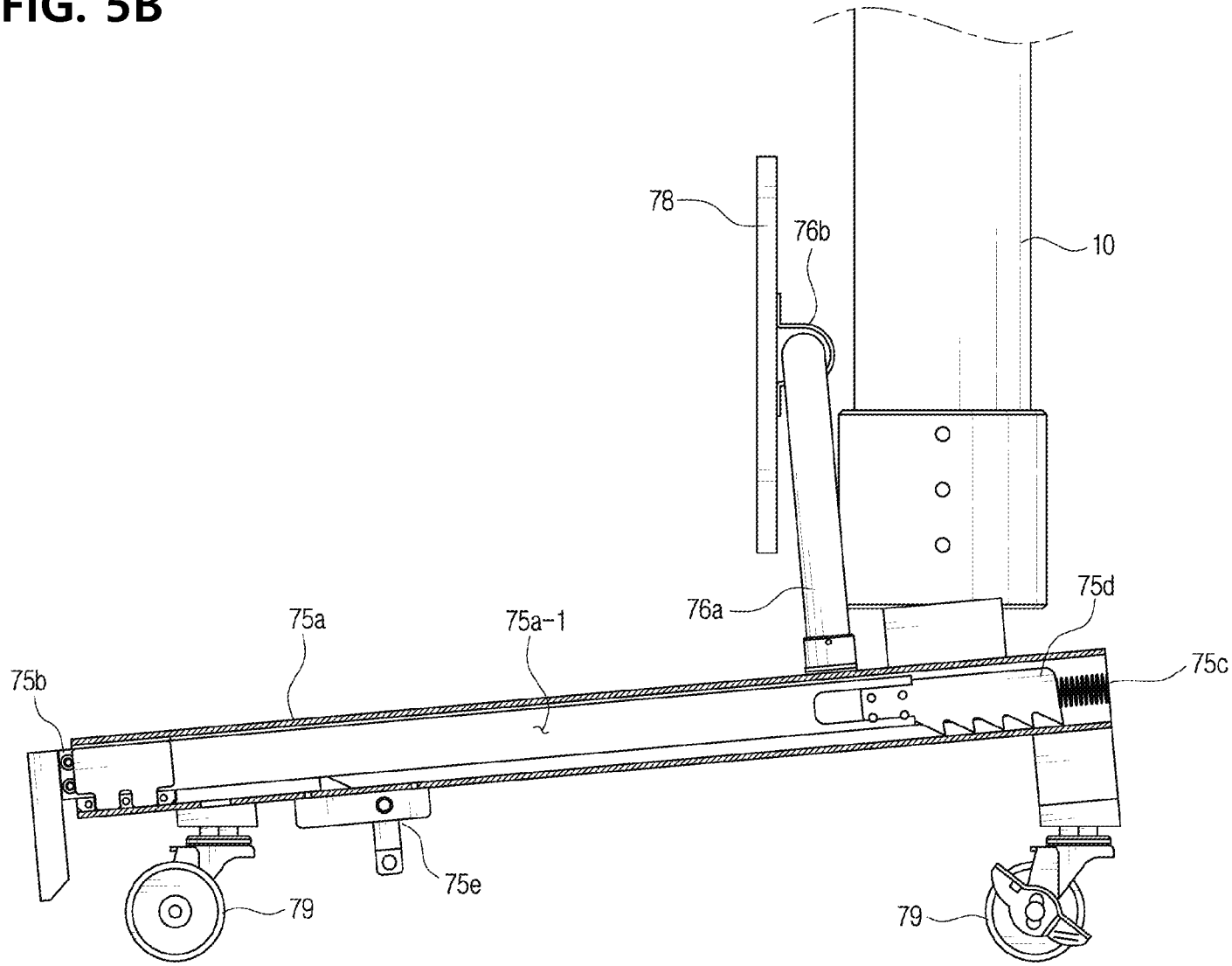
FIG. 5B is a conceptual diagram showing an example of a base frame when a second member is received in a first member and a knee support part is far away from a patient.

FIGS. 1, 5A and 5B show an example in which a coupling frame 71 is installed below the support part 10, and the first member 75*a* is each connected to two ends of the coupling frame 71.

The second member 75*b* is inserted into and guided by the received guide part and moves relative to the first member 75*a*. The knee support part 78 may be installed in the second member 75*b*.

Although not clearly shown, FIG. 5A shows an example in which a connecting link 76*a* is installed in the second member 75*b* and the knee support part 78 is installed in the connecting link 76*a* by a fixing part 76*b*. Accordingly, the knee support part 78 may move together with the second member 75*b*, and thus the location may be adjusted in consideration of the position or physical dimension of the patient.

The base frame 70 may further include an elastic part 75*c*, a ratchet gear 75*d* and a stopper part 75*e*.

The elastic part 75*c* is installed in the first member 75*a* and elastically deforms between the first and second members 75*a*, 75*b* when the second member 75*b* moves relative to the first member 75*a*, so that an elastic force is provided to the knee support part 78. For example, the elastic part 75*c* may be installed in the received guide part 75*a*-1. The elastic part 75*c* may be a spring.

The ratchet gear 75*d* may be installed at the end of the second member 75*b* and placed along the direction in which the second member 75*b* extends. FIGS. 5A and 5B show an example of the ratchet gear 75*d*, and the teeth of the ratchet gear 75*d* may include a slope part formed diagonally and a jaw part formed in perpendicular direction to the ground.

The stopper part 75*e* is installed in the first member 75*a* to latch the ratchet gear 75*d* to limit the movement of the knee support part 78 toward the support part 10. Referring to FIGS. 5A and 5B, the stopper part 75*e* allows the movement to the left by the slope part of the ratchet gear 75*d*, and limits the movement to the right by latching by the jaw part of the ratchet gear 75*d*. As described above, the second member 75*b* may move to the left with respect to the first member 75*a* by the stopper part 75*e* and the ratchet gear 75*d*, and the movement to the right is limited.

A plurality of castors 79 may be installed at the lower end of the base frame 70, and the plurality of castors 79 allows the support part 10 and its connected elements to move.

The standing assistance apparatus 100 of the present disclosure may further include the driving part 50 and the power transmission part 60.

The driving part 50 is installed in the support part 10 to generate driving power for allowing the patient to stand.

The driving part 50 may include a gas cylinder 52 and a gas spring 56.

The gas cylinder 52 is installed in one direction within the support part 10 to generate the driving power. The gas cylinder 52 may generate a force of about 20 kgf.

The gas spring 56 is installed in parallel with the gas cylinder 52 within the support part 10 to assist the generation of driving power. The gas spring 56 assists the driving power of the gas cylinder 52 to allow the gas cylinder 52 to generate a force of about 25 kgf.

Additionally, the driving part 50 may further include a guide rod 58. The guide rod 58 is installed in parallel with the gas cylinder 52 within the support part 10, and is supplied with the driving power and is guided by a guide hole of a fixed block together with the gas cylinder 52. The fixed block is installed at the inner periphery of the support part 10, and has the guide hole formed in one direction.

Figure 2B:
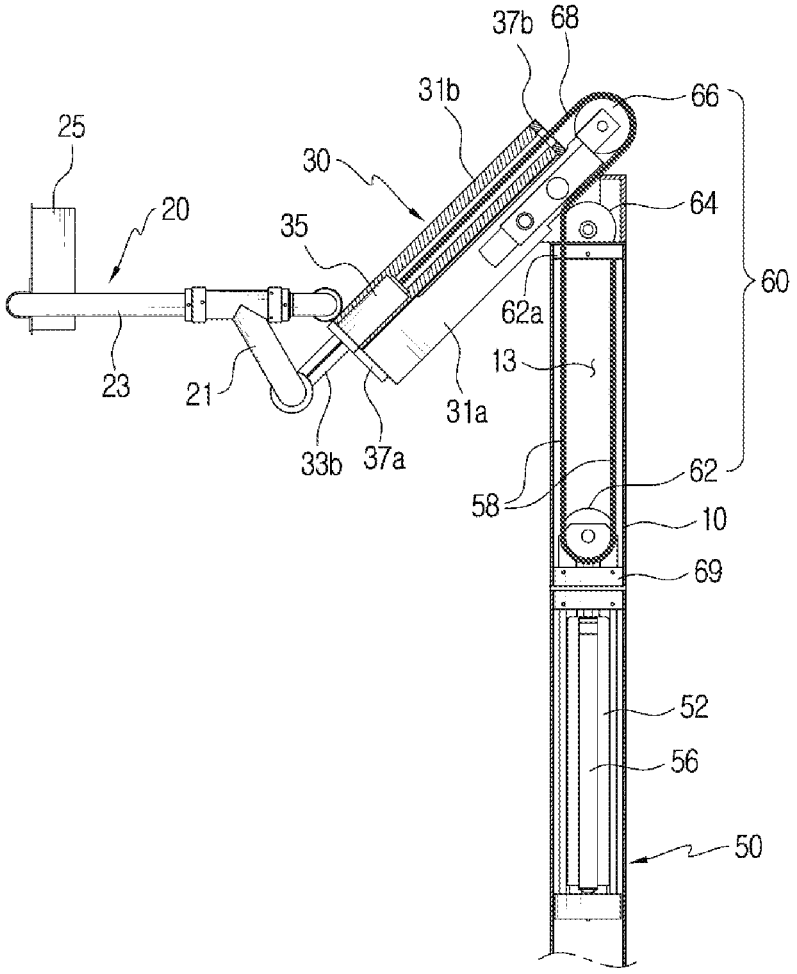
FIG. 2B is a conceptual diagram showing the structure and operation of a guide part, a driving part and a power transmission part when a patient stands up.

Referring to FIGS. 2A and 2B, the gas cylinder 52 and the gas spring 56 generate driving power in the up/down direction within the support part 10, and the driving power is provided to the guide part 30 through the power transmission part 60.

The power transmission part 60 is connected between the driving part 50 and the guide part 30, and transmits the driving power generated by the driving part 50 to the guide part 30 so that the length of the guide part 30 may be adjusted.

The power transmission part 60 may include first to third pulleys 62, 64, 66 and a wire 68.

The first pulley 62 is configured to move using the driving power supplied from the driving part 50. The first pulley 62 may be rotatably installed at the upper end of the driving part 50, and FIGS. 2A and 2B show an example in which a pulley housing 62*a* is coupled to the upper end of the guide rod 58, and the first pulley 62 is rotatably installed in the pulley housing 62*a*. Additionally, the first pulley 62 may move in the up/down direction within the support part 10 by the wire 68 as described below. FIG. 2A shows an example in which the first pulley 62 moves between the third pulley 66 and the fixed block 69 by the wire 68. The first pulley 62 may be a moving pulley.

The second and third pulleys 64, 66 may be installed at adjacent ends of the support part 10 and the guide part 30 respectively. FIG. 2A shows an example of the second pulley 64 rotatably installed at the upper part of the support part 10, but although not clearly shown, a second pulley housing may be fixed and installed at the upper part of the support part 10, and the second pulley 64 may be rotatably coupled to the second pulley housing through a rotation axis. Additionally, an example is shown in which the third pulley 66 is rotatably installed in a pulley connection part 31*a*-1 at the end of the first case 31*a* of the guide part 30. However, the installation method of the second and third pulleys 64, 66 is not limited thereto, and the second and third pulleys 64, 66 may be installed in various ways to transmit the driving power generated by the driving part 50 to the guide part 30.

Each of the second and third pulleys 64, 66 may be a fixed pulley.

The wire 68 is installed in the first to third pulleys 62, 64, 66. Additionally, one end of the wire 68 is fixed to the inner side of the support part 10, and the other end is fixed to the other end of the guide part 30. FIG. 2A shows an example in which one end of the wire 68 is fixed to the inner side of the support part 10 and is wound on the bottom of the first pulley 62 and parts of each of the third and second pulleys 66, 64, and the other end is fixed to the end of the second shaft 33*b* of the guide part 30.

As described, by the first to third pulleys 62, 64, 66, the patient may stand up with a force of ½ of the force required when the first to third pulleys 62, 64, 66 are not installed and only the wire 68 is connected. Additionally, it is possible to offer double strokes for the gas cylinder 52 and the gas spring 56, thereby reducing the problem with bulking in terms of weight and size.

Meanwhile, an angle adjustment part 90 may be installed at the upper part of the support part 10, and the angle adjustment part 90 may be disposed between the support part 10 and the first case 31*a*. The angle adjustment part 90 has a plurality of holes that is spaced apart from each other in circumferential direction with respect to a point, and a protrusion is formed at the outer periphery of the first case 31*a* such that the protrusion may be inserted into the holes of the angle adjustment part 90. Accordingly, as the guide part 30 may pivot around the support part 10, the guide part 30 may be fixed to the support part 10 when the protrusion of the first case 31*a* is inserted into one of the holes of the angle adjustment part 90, thereby adjusting the angle between the support part 10 and the guide part 30.

For example, in FIG. 1, when the protrusion of the first case 31*a* is inserted into the lowest hole on the left side within the angle adjustment part 90, the guide part 30 is disposed nearly in parallel with the support part 10, forming a structure that is easy to receive the standing assistance apparatus 100 of the present disclosure. Additionally, an example is shown in which the protrusion of the first guide frame 31 is inserted into the other hole within the angle adjustment part 90, forming an angle of about 45° between the guide part 30 and the support part 10. As described above, the angle between the support part 10 and the guide part 30 may be adjusted by the angle adjustment part 90, thereby minimizing the volume of the standing assistance apparatus 100 when receiving the standing assistance apparatus 100, and guiding the standing while adjusting the standing angle to suit the patient's physical dimensions when using the standing assistance apparatus 100.

The standing assistance apparatus 100 of the present disclosure may further include a handle part 80.

The handle part 80 may be installed in the support part 10, and may have a rod shape to easily guide the standing of the patient. FIG. 1 shows an example of the handle part 80 formed in the shape of a rod that is bent multiple times. It is desirable to adjust the height at which the handle part 80 is installed in the support part 10 and the distance from the handle part 80 to the patient, taking into account the patient's physical condition.

A manipulation part 83 may be installed in the handle part 80 to manipulate the stopper part 75*e* of the base frame 70. The manipulation part 83 moves the stopper part 75*e* to disengage from the ratchet gear 75*d*.

Hereinafter, an experiment performed in relation to the standing assistance apparatus 100 of the present disclosure will be described.

Figure 6A:
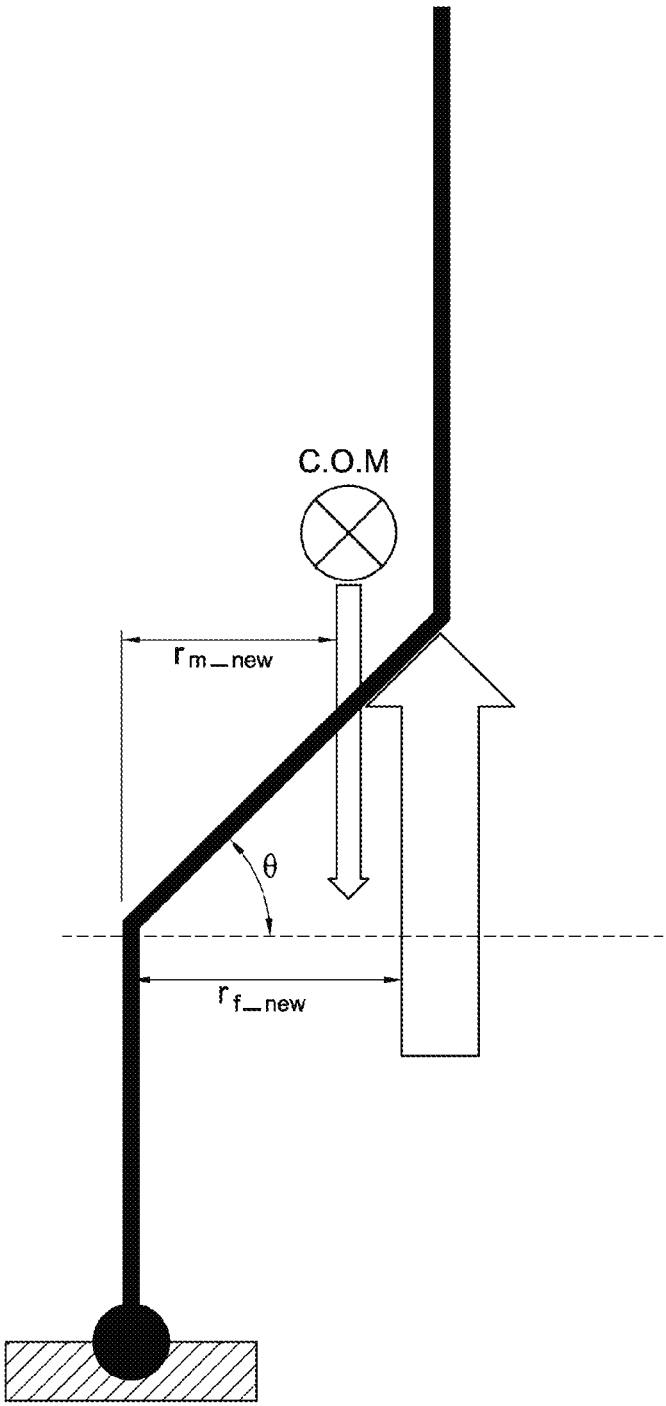
FIG. 6A is a conceptual diagram showing forces acting on a human body in a vertical direction standing assistance method.
Figure 6B:
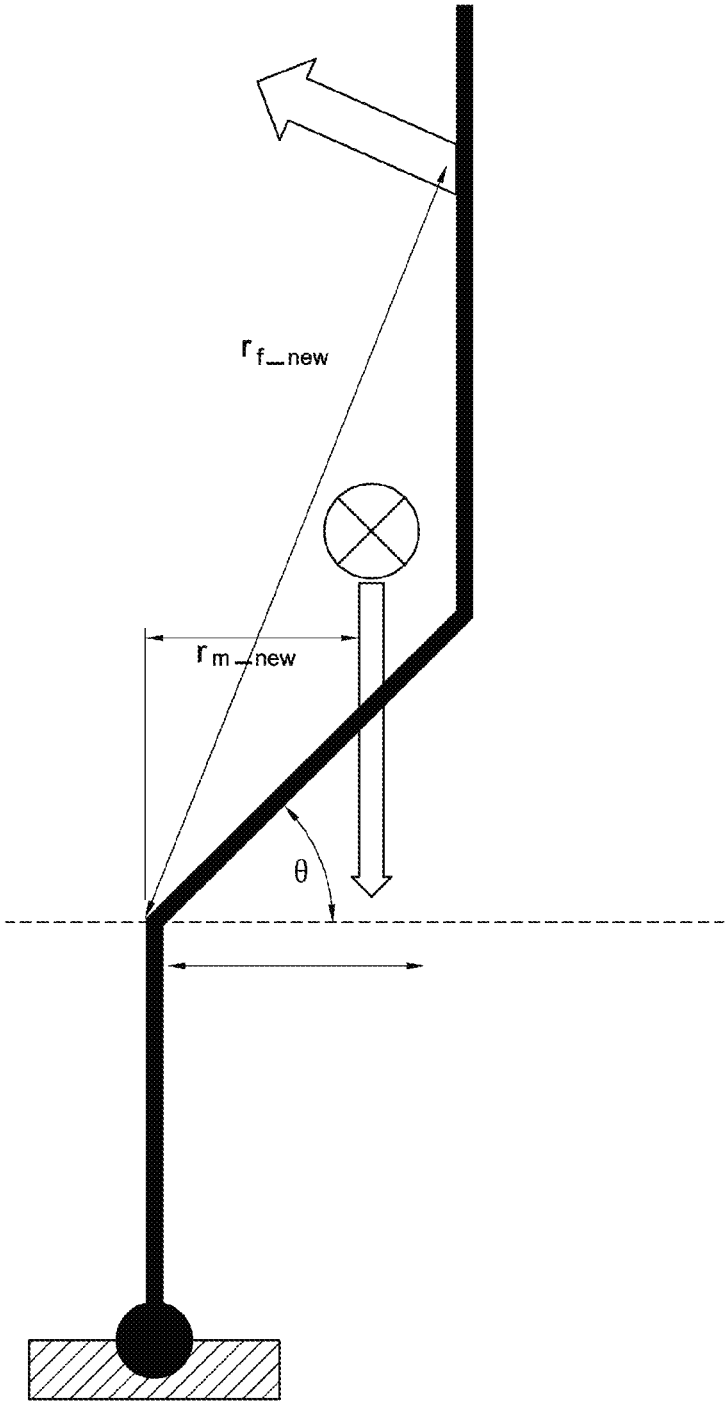
FIG. 6B is a conceptual diagram showing forces acting on a human body in a diagonal direction standing assistance method.

FIG. 6A is a conceptual diagram showing forces acting on a human body in a vertical direction standing assistance method, and FIG. 6B is a conceptual diagram showing forces acting on a human body in a diagonal direction standing assistance method.

The present disclosure is directed toward a diagonal direction support assisting method, and obtained the conclusion that as a result of kinematics simulation and direct experiments, the diagonal direction support assisting method may assist the user with a smaller force than the vertical standing assistance method. Additionally, the support for raising up is reduced and the sitting restoration force required is small, so the old person may restore by his/her weight.

In the convention vertical standing assistance method, the support is about 55 kgf and the sitting restoration force required is about 55 kgf, but when the diagonal direction support assisting method is used, the sitting restoration force is reduced to 27 kgf which is nearly half.

Figure 7A:
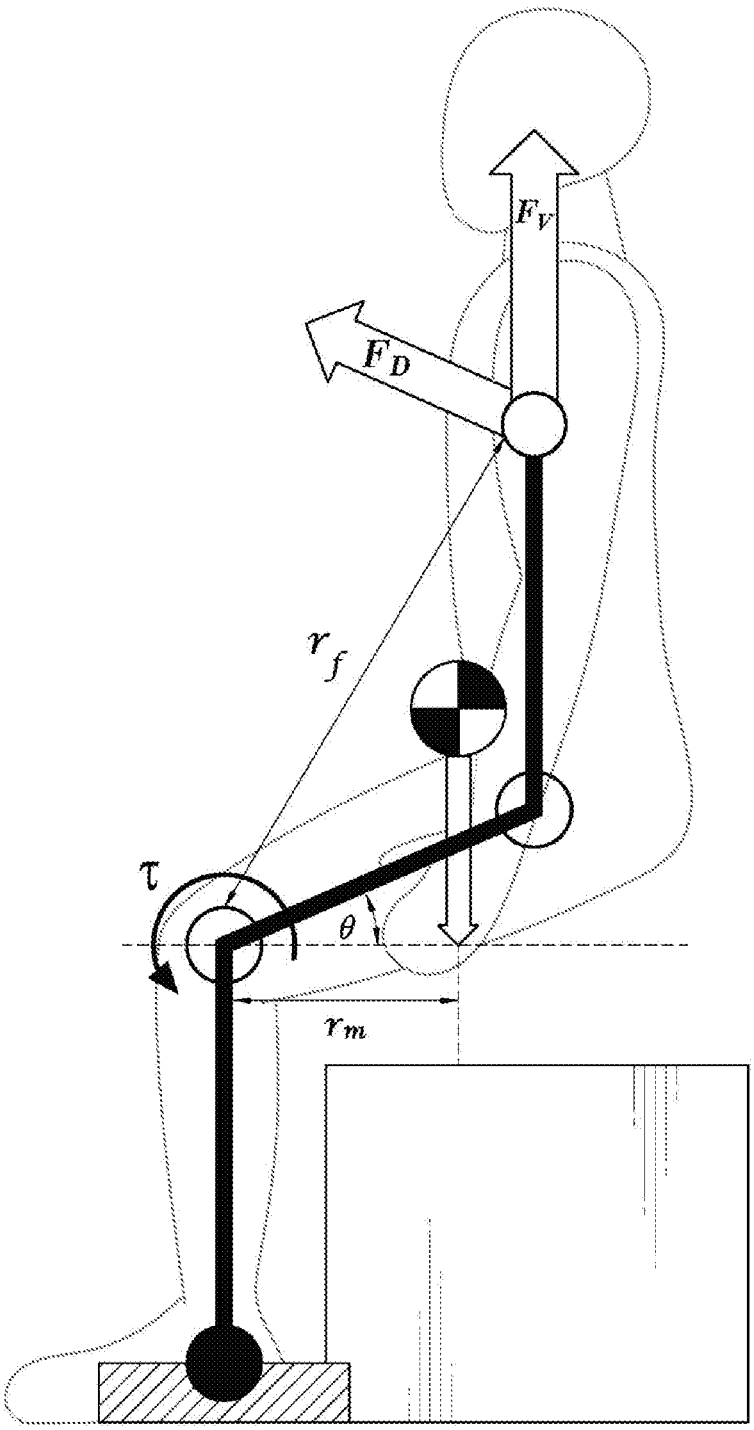
FIG. 7A is a conceptual diagram showing forces and torques in vertical and diagonal directions at an arbitrary standing position.
Figure 7B:
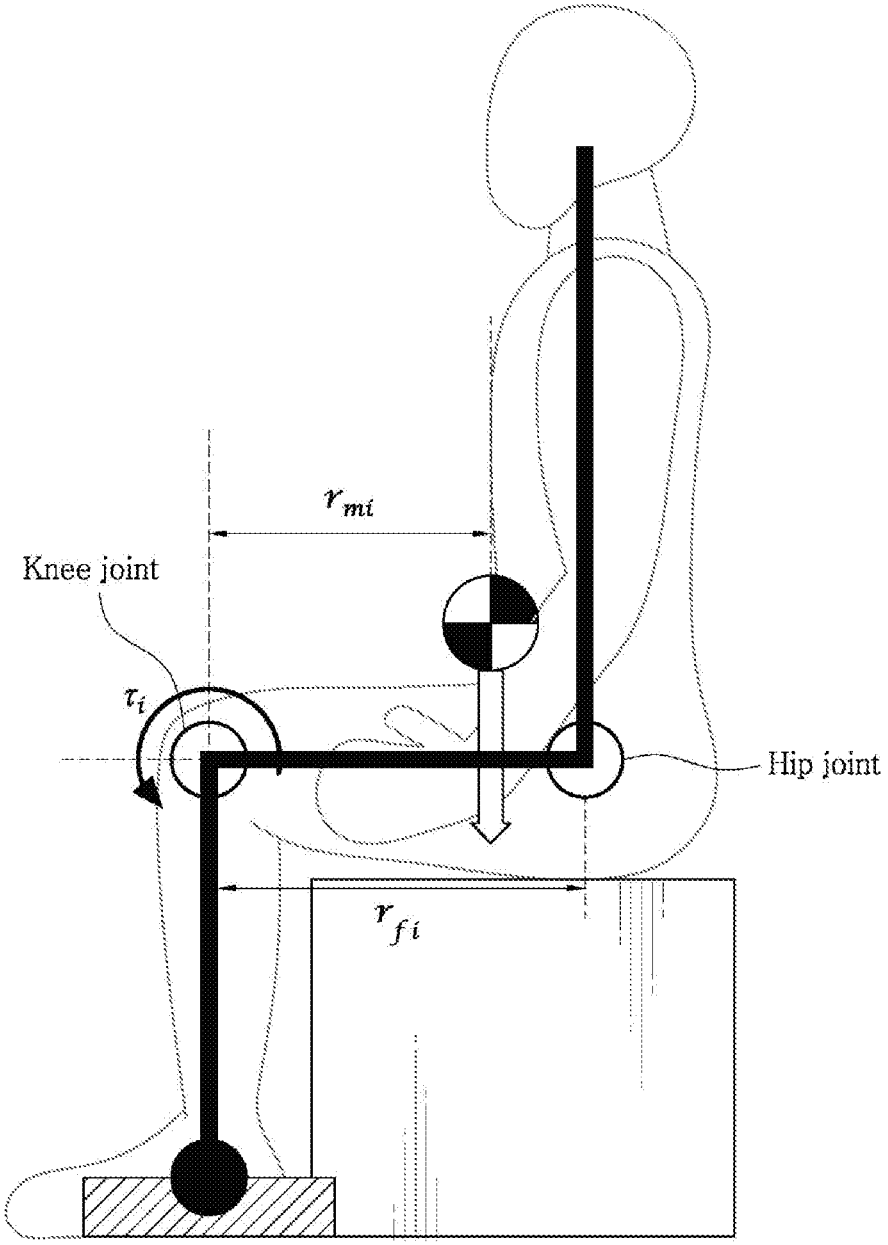
FIG. 7B is a conceptual diagram showing torques at initial position.

FIG. 7A is a conceptual diagram showing forces and torques in vertical and diagonal directions at an arbitrary standing position, and FIG. 7B is a conceptual diagram showing torques at initial position.

In FIGS. 7A and 7B, Fv denotes the vertical direction spring force for standing, $F_D$ denotes the diagonal direction spring force for standing, $\tau_i$ denotes the torque at the initial position, $\tau$ denotes the torque at an arbitrary standing position, $r_m$ denotes the distance between the knee joint and the center of gravity at an arbitrary standing position, and $r_f$ denotes the distance between the knee joint and the point of action at an arbitrary standing position.

In comparison from the perspective of torque, simulation experiment is performed to compare joint torques for vertical direction support Fv/diagonal direction support Fd. The torque formula is $\tau=(-mg\times r_m)+(F\times r_f)$.

Figure 8:
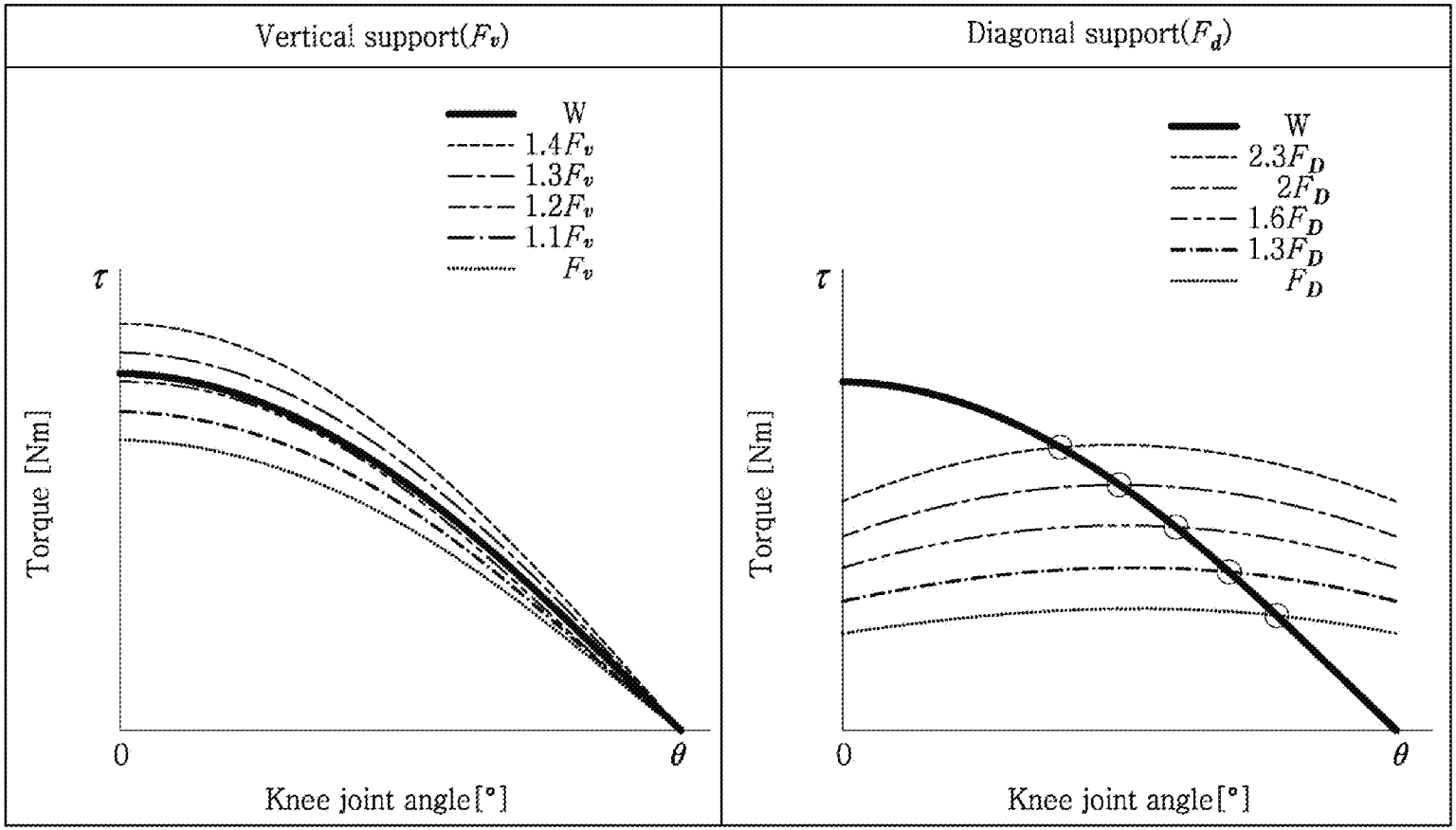
FIG. 8 is a graph of vertical direction standing and diagonal direction standing.

FIG. 8 is a graph of vertical direction standing and diagonal direction standing.

The left graph of FIG. 8 about vertical direction standing shows the knee joint torque changes occurring by Fv with the knee joint angle changes, in which the torque by the spring force is greater than the torque by the weight (torque at the full range of angles), and it is difficult to restore the standing assistance apparatus to the initial position.

The right graph of FIG. 8 about diagonal direction standing shows the knee joint torque changes occurring by Fd with the knee joint angle changes, in which the standing assistance torque is greater than the torque by the weight (angle after the point of intersection), and a force is necessary at the initial position, but it is easy to restore to the initial position.

In the graph of FIG. 8, the blue line indicates the torque needed for the patient/old person to stand. The amounts of torque compensation with the knee joint angle changes of F.B.D human body model are compared at two viewpoints of vertical/diagonal direction support. In the case of the vertical direction support Fv, the support having the same tendency with the angle changes of the knees is produced. As shown in the graph, it can be seen that when the vertical direction support is 1.4 Fv, it is greater than the torque W applied to the knees by the weight over the full range. Additionally, significant assistance is possible when the torque generated by the support is greater than the torque generated by the weight. In addition, in the case of manual standing assistance devices, because an electric motor is not used, there are difficulties in having to restore the standing assistance device to the initial position directly by hands. In the case of vertical direction standing, a force is needed to restore to the initial position as much as the force used to assist. In contrast, in the case of the mechanism for assisting with the diagonal direction support Fd, high assisting torque on average is generated with a force that is lower than the weight. Additionally, there is a tendency that is different from the knee torque generated by the weight. When the knee joint angle is 0° and 90°, the support is lowest, and the highest assisting torque is generated at the point where the joint angle is 45°. In other words, with regard to the torque generated at the knees by the weight and the torque by the support, on the basis of the point of intersection at which lines intersect, the torque by the weight is greater than the torque by the support before the point of intersection. In contrast, after the point of intersection, the torque by the support is greater than the torque by the weight. It is possible to produce the support of higher efficiency with a force for standing that is smaller about 2-3 times. However, before the point of intersection, it is necessary to generate a small force by the muscular strength of the patient. However, in the case of typical paraplegic patients or old people, the lower body muscular strength is insufficient, but the muscular strength in arms is not lost. Additionally, in an attempt to stand, only if an assistant pulls slightly, it will work as a trigger definitely to allow them to stand.

Figure 9A:
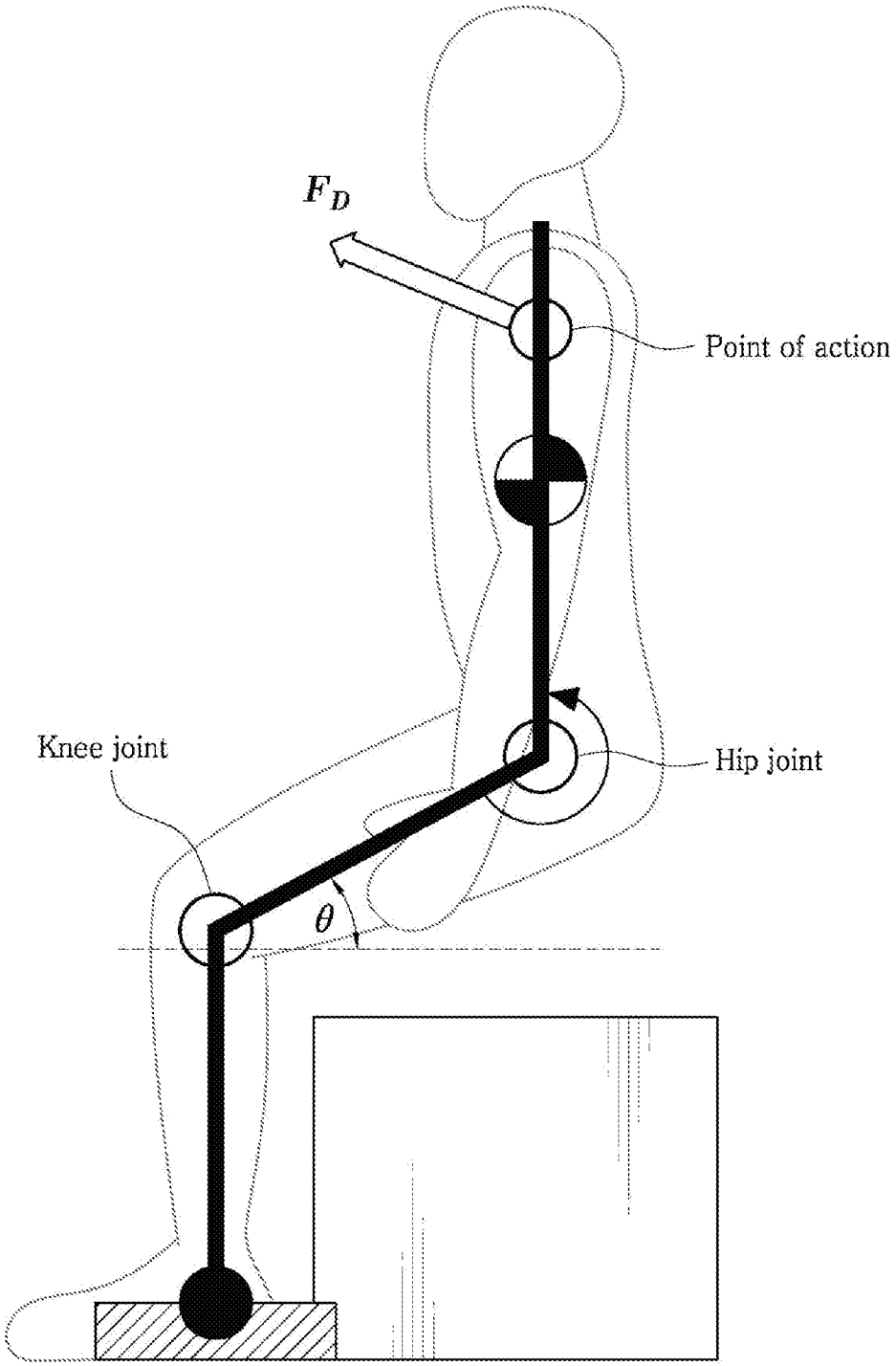
FIG. 9A is a conceptual diagram showing the tendency of assisting torque based on the location of point of action.
Figure 9B:
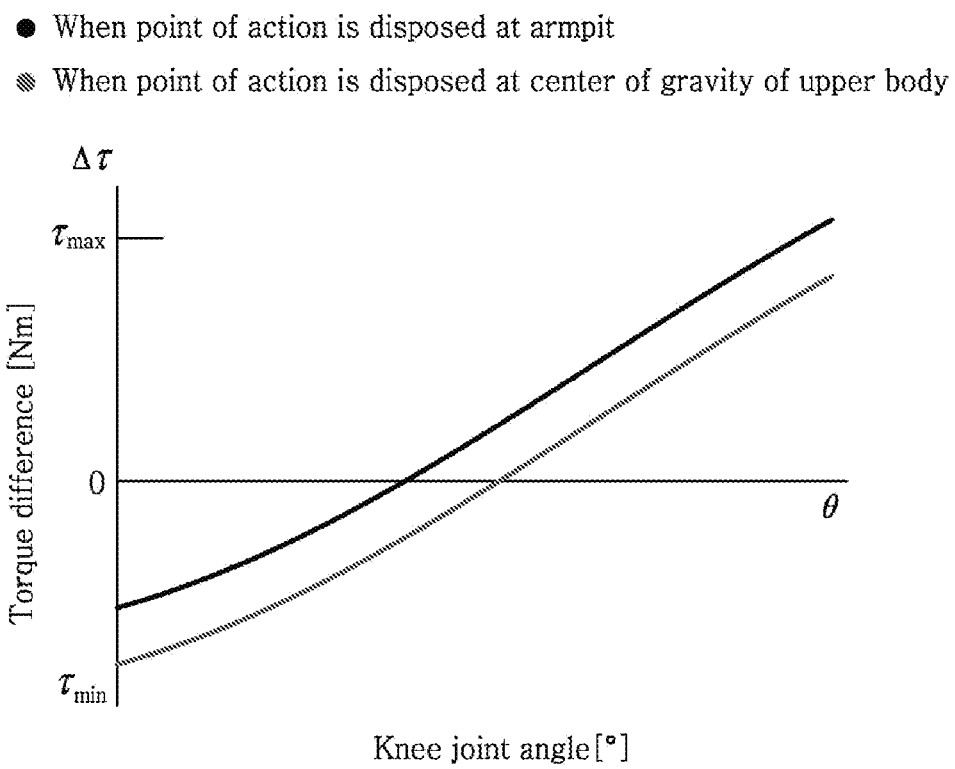
FIG. 9B is a graph showing the result of subtracting a knee assisting torque by diagonal direction support and a knee torque by weight.

FIG. 9A is a conceptual diagram showing the tendency of assisting torque based on the location of point of action, and FIG. 9B is a graph showing the result of subtracting a knee assisting torque by diagonal direction support and a knee torque by weight.

In FIG. 9B, the positive direction indicates the assisted torque, and the negative direction indicates the torque the user is required to apply directly. As the location of the point of action of support is closer to the center of gravity of the upper body, the torque that may assist decreases. On the contrary, when the point of action is disposed near the armpits, the torque that may assist increases. In summary, it can be seen that as the location of the point of action is higher than the center of gravity of the upper body, the assisting torque for the knees increases. However, although not shown in the graph, it is expected that a gain torque generated by a difference in the location of the point of action will be applied to the hip joint. This indicates the need for methodology that selects a suitable location of point of action for the level of muscular strength of the patient.

The standing assistance apparatus of the present disclosure assists the patient or old person with a small force because the guide part is disposed in diagonal direction and the shaft is inserted into the case and makes a relative motion.

The standing assistance apparatus of the present disclosure may assist patients or weak and old people to stand without using an electric power source by generating driving power by the gas spring and the gas cylinder and transmitting the generated driving power to the guide part through the pulley and the wire.

The standing assistance apparatus 100 described hereinabove is not limited to the configuration and method of the embodiments described in the foregoing, and some or all the embodiments may be selectively combined to make various modifications to the embodiments.

It is obvious to those skilled in the art that the present disclosure may be embodied in other specific forms without departing from the spirit and essential features of the present disclosure. Therefore, the detailed description should not be interpreted as limitative in all aspects, and should be considered as exemplary. The scope of the present disclosure should be determined by the reasonable interpretation of the appended claims, and all modifications within the equivalent scope of the present disclosure fall in the scope of the present disclosure.

What is claimed is:

1. A standing assistance apparatus, comprising:

a support part configured to support a load;

a saddle part configured to accommodate a patient to allow the patient to position from sitting condition to standing condition; and a guide part coupled between the support part and the saddle part, and having an adjustable length to guide the patient to stand, wherein the guide part is disposed in diagonal direction with respect to the support part to guide the patient to stand in the diagonal direction.

2. The standing assistance apparatus according to claim 1, further comprising:

a frame installed below the support part to support the support part, wherein a knee support part is installed in the frame to support the patient's knees.

3. The standing assistance apparatus according to claim 2, wherein the frame comprises:

a first member which is connected to bottom of the support part and extends in a direction in which the first member intersects with the support part, the first member having a received guide part therein along the direction in which the first member extends; and a second member which is inserted into and guided by the received guide part moveably relative to the first member, and wherein the knee support part is installed in the second member.

4. The standing assistance apparatus according to claim 3, wherein the frame further comprises:

an elastic part which is installed within the first member, wherein the elastic part elastically deforms between the first and second members when the second member moves relative to the first member, to provide an elastic force to the knee support part;

a ratchet gear which is installed at an end of the second member and is disposed along a direction in which the second member extends; and a stopper part which is installed in the first member to latch the ratchet gear to limit a movement of the knee support part toward the support part.

5. The standing assistance apparatus according to claim 1, further comprising:

a driving part which is installed within the support part to generate driving power for allowing the patient to stand; and a power transmission part which is connected between the driving part and the guide part to transmit the generated driving power to the guide part to adjust the length of the guide part.

6. The standing assistance apparatus according to claim 5, wherein the driving part comprises:

a gas cylinder which is installed in one direction within the support part to generate the driving power; and a gas spring which is installed in parallel with the gas cylinder within the support part to assist a generation of the driving power.

7. The standing assistance apparatus according to claim 6, wherein a fixed block is installed at an inner periphery of the support part, and has a guide hole formed in one direction, and the driving part further comprises a guide rod installed in parallel with the gas cylinder within the support part, and the guide rod is supplied with the driving power and guided by the guide hole together with the gas cylinder.

8. The standing assistance apparatus according to claim 5, wherein the power transmission part comprises:

a first pulley which is connected to the driving part to move using the driving power received from the driving part;

second and third pulleys which are installed at adjacent ends of the support part and the guide part respectively; and a wire having two ends, one end fixed to an inner side of the support part and other end fixed to the guide part, the wire being installed in the first to third pulleys to transmit the driving power generated by the driving part to the guide part through the first to third pulleys.

9. The standing assistance apparatus according to claim 1, wherein the guide part comprises:

a case having a shaft receiving part inside and extending in the diagonal direction; and a shaft which is inserted into the shaft receiving part moveably relative to the case.

10. The standing assistance apparatus according to claim 9, wherein the guide part further comprises:

a boss which is installed at an outer periphery of the shaft to guide a movement of the shaft, and latch an end of the shaft to limit the movement of the shaft.

11. The standing assistance apparatus according to claim 9, wherein two cases and two shafts are provided, wherein a first case is coupled to the support part, and a first shaft is inserted into the first case moveably relative to the first case, wherein a second case is disposed in parallel with the first case at an outer periphery of the first case, and a second shaft is inserted into the second case moveably relative to the second case with one end being coupled to the saddle part, and wherein the first case has a cutout part which is cut along the diagonal direction at the outer periphery of the first case, and the second case is guided by the cutout part and makes a relative motion in the diagonal direction with respect to the first case.

12. The standing assistance apparatus according to claim 11, wherein connecting plate is installed at ends of the first shaft and the second case to connect the first shaft and the second case each other, and the connecting plate allows the first shaft and the second case to move relative to the first case together.

* * * * *